US009765733B2

(12) United States Patent
Tochihara et al.

(10) Patent No.: US 9,765,733 B2
(45) Date of Patent: Sep. 19, 2017

(54) EVAPORATION FUEL PURGE SYSTEM

(71) Applicant: HAMANAKODENSO CO., LTD, Kosai, Shizuoka-pref. (JP)

(72) Inventors: Hideya Tochihara, Kosai (JP); Tetsunori Inoguchi, Hamamatsu (JP)

(73) Assignee: Hamanakodenso Co., Ltd., Kosai, Shizuoka-Pref. (JP)

( * ) Notice: Subject to any disclaimer, the term of this patent is extended or adjusted under 35 U.S.C. 154(b) by 12 days.

(21) Appl. No.: 14/877,998

(22) Filed: Oct. 8, 2015

(65) Prior Publication Data

US 2016/0108864 A1 Apr. 21, 2016

(30) Foreign Application Priority Data

Oct. 17, 2014 (JP) ..... 2014-212975

(51) Int. Cl.
*F02M 25/08* (2006.01)
*F02M 35/10* (2006.01)

(52) U.S. Cl.
CPC ..... *F02M 25/089* (2013.01); *F02M 25/0809* (2013.01); *F02M 25/0836* (2013.01); *F02M 25/0872* (2013.01); *F02M 35/10222* (2013.01)

(58) Field of Classification Search
CPC ..... F02M 25/0809; F02M 25/089; F02M 25/0836; F02M 25/0872; F02M 25/0854; F02D 41/004; F02D 41/0045
See application file for complete search history.

(56) References Cited

U.S. PATENT DOCUMENTS

| | | | | |
|---|---|---|---|---|
| 9,097,216 | B2 * | 8/2015 | Itoh | F02M 25/0854 |
| 2002/0066440 | A1 | 6/2002 | Kano et al. | |
| 2002/0162457 | A1 | 11/2002 | Hyodo et al. | |
| 2004/0173190 | A1 * | 9/2004 | Makino | F02D 41/004 123/520 |
| 2013/0112176 | A1 * | 5/2013 | Peters | F02M 25/0809 123/521 |
| 2013/0199504 | A1 | 8/2013 | Takeishi et al. | |
| 2013/0253799 | A1 * | 9/2013 | Peters | F02M 25/0818 701/102 |

FOREIGN PATENT DOCUMENTS

| | | |
|---|---|---|
| JP | 2002-221105 | 8/2002 |
| JP | 4082004 | 2/2008 |
| JP | 2013160108 A | 8/2013 |

* cited by examiner

*Primary Examiner* — Hung Q Nguyen
*Assistant Examiner* — Xiao Mo
(74) *Attorney, Agent, or Firm* — Harness, Dickey & Pierce, P.L.C.

(57) ABSTRACT

An evaporation fuel purge system includes: a fuel tank; a canister that absorbs and desorbs evaporation fuel emitted from the fuel tank; an intake passage for an internal combustion engine in which the evaporation fuel desorbed from the canister is mixed with fuel for combustion; a purge passage that connects the canister to the intake passage; an ejector device disposed in the purge passage; and a fluid drive device. The ejector device has a nozzle part that accelerates external fluid. The fluid drive device sends outside air corresponding to the external fluid to flow into the nozzle part.

19 Claims, 7 Drawing Sheets

EVAPORATION FUEL PURGE SYSTEM

CROSS REFERENCE TO RELATED APPLICATION

This application is based on Japanese Patent Application No. 2014-212975 filed on Oct. 17, 2014, the disclosure of which is incorporated herein by reference in its entirety.

TECHNICAL FIELD

The present disclosure relates to an evaporation fuel purge system.

BACKGROUND

An evaporation fuel purge system has a pump which pumps evaporation fuel. Such a system is used for a vehicle such as hybrid car or idling stop vehicle, in which processing time of evaporation fuel is comparatively short, or a vehicle having an engine with a turbocharger or a low friction engine car, in which a negative pressure is small at an intake manifold.

JP 4082004 B2 (corresponding to US 2002/0162457 A1) describes such a system, in which evaporation fuel is drawn from a canister with a purge pump, and the evaporation fuel is sent to an intake passage for an engine through a purge control valve. The purge pump is arranged on a piping through which evaporation fuel flows.

Since the evaporation fuel pumped by the purge pump passes through the purge pump, a flameproof structure is needed for the purge pump. Moreover, when the purge pump stops, the purge pump itself may be a resistance for a flow of evaporation fuel.

SUMMARY

It is an object of the present disclosure to provide an evaporation fuel purge system in which a flameproof structure is not needed and a purge pump does not increase a resistance for a flow of evaporation fuel.

According to an aspect of the present disclosure, an evaporation fuel purge system includes: a fuel tank that stores fuel; a canister that absorbs evaporation fuel when evaporation fuel is emitted from the fuel tank, the canister being able to desorb the evaporation fuel; an intake passage for an internal combustion engine in which the evaporation fuel desorbed from the canister is mixed with fuel for combustion; a purge passage that connects the canister to the intake passage; an ejector device disposed in the purge passage and having a nozzle part that accelerates external fluid flowing into, a suction part that draws the evaporation fuel from the canister by a drawing force produced by the external fluid ejected from the nozzle part, and a diffuser part that emits mixture of the external fluid ejected from the nozzle part and the evaporation fuel drawn from the suction part into the intake passage; and a fluid drive device that sends outside air corresponding to the external fluid to flow into the nozzle part.

Accordingly, the evaporation fuel is drawn from the canister by the drawing force of the external air pumped into the nozzle part of the ejector device by the fluid drive device. The evaporation fuel is mixed with the external air in the ejector device and is sent toward the intake passage as a mixture fluid. Therefore, evaporation fuel flows inside the purge passage without flowing through the fluid drive device, and the mixture fluid can be supplied to the intake passage.

Thus, a flameproof structure is not needed for the purge pump, and the purge pump does not increase a resistance for a flow of evaporation fuel.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
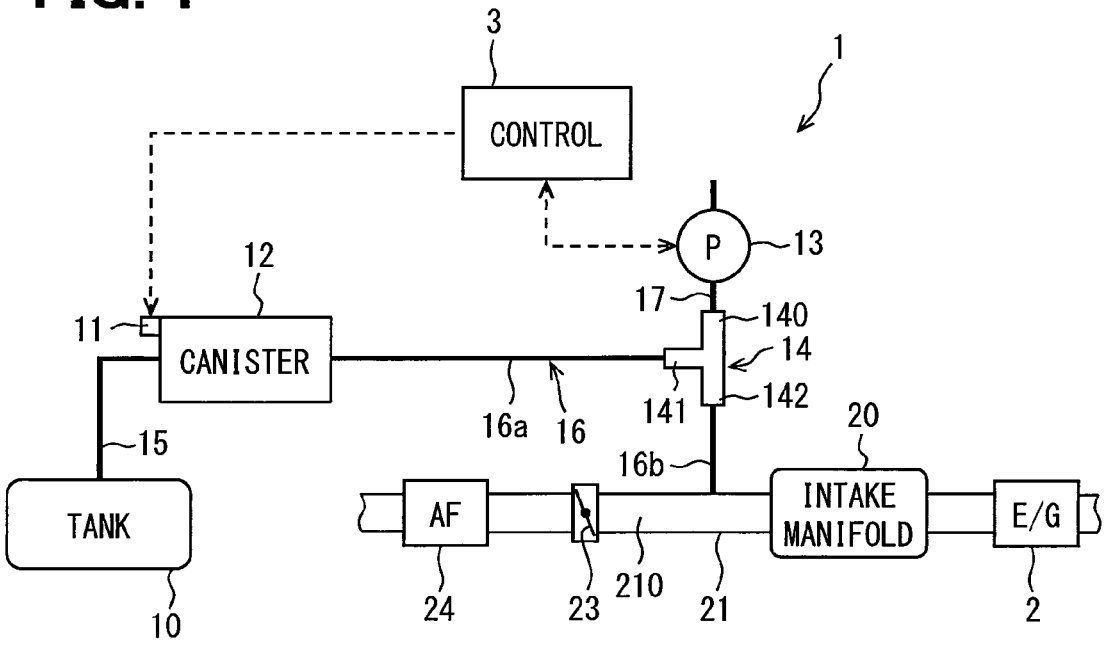
FIG. 1 is a schematic view illustrating an evaporation fuel purge system according to a first embodiment.
Figure 2:
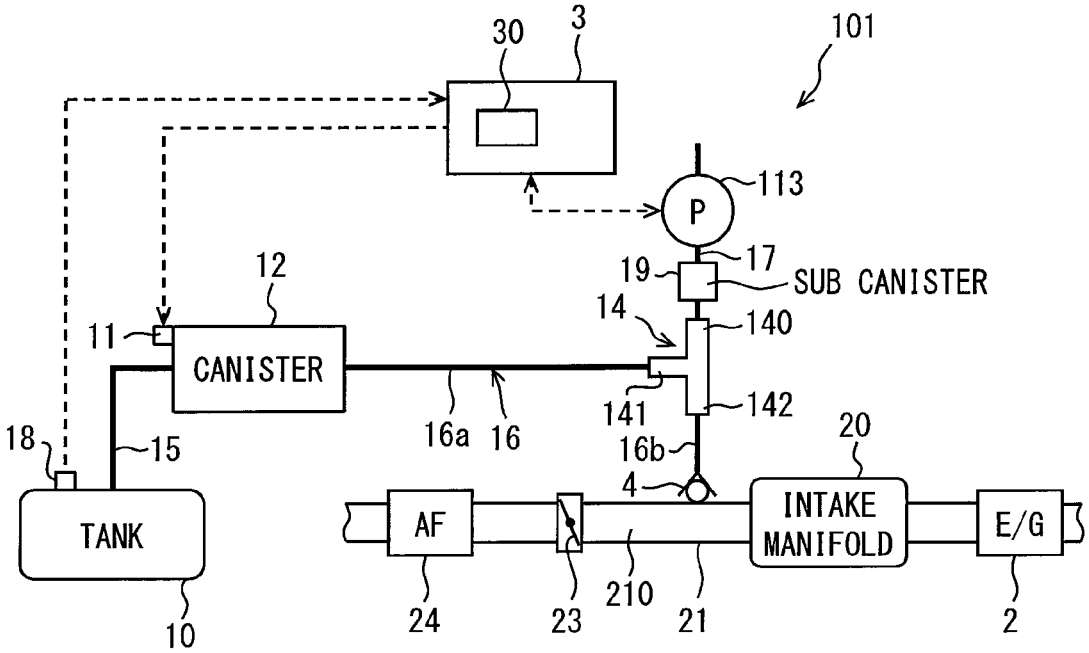
FIG. 2 is a schematic view illustrating an evaporation fuel purge system according to a second embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

An evaporation fuel purge system 1 according to a first embodiment is explained referring to FIG. 1. The evaporation fuel purge system 1 supplies, for example, HC gas in fuel absorbed in a canister 12 to an intake passage 210 of an internal combustion engine 2, and prevents evaporation fuel from being emitted from a fuel tank 10 to the atmosphere. As shown in FIG. 1, the evaporation fuel purge system 1 is equipped with an intake system for the internal combustion engine 2 with the intake passage 210, and a purge system which supplies evaporation fuel to the intake system of the internal combustion engine 2.

The evaporation fuel introduced into the intake passage 210 is mixed with fuel for combustion supplied to the internal combustion engine 2 from an injector, and is combusted within the cylinder of the internal combustion engine 2. The intake system of the internal combustion engine 2 has an intake pipe 21 connected to an intake manifold 20, which is a part of the intake passage 210, through a throttle valve 23. An air filter 24 is disposed in the intake pipe 21.

In the purge system, the canister 12 is connected to the fuel tank 10 through a vapor passage 15, and the intake passage 210 is connected to the canister 12 through a purge passage 16. The purge passage 16 includes a first purge passage 16*a* and a second purge passage 16*b*. The first purge passage 16*a* connects the canister 12 to a suction part 141 of an ejector device 14. The second purge passage 16*b* connects the intake passage 210 to a diffuser part 142 of the ejector device 14. The purge passage 16 includes a part of the ejector device 14 which connects the first purge passage 16*a* and the second purge passage 16*b* with each other, in addition to the first purge passage 16*a* and the second purge passage 16*b*.

The evaporation fuel purge system 1 has the ejector device 14 and a pump device 13 pumping air from outside (henceforth may be referred to as outside air or external air) into the nozzle part 140 of the ejector device 14. The evaporation fuel purge system 1 is able to draw evaporation fuel into the suction part 141 of the ejector device 14 using the air.

The ejector device 14 corresponds to a fluid pump which draws evaporation fuel due to a negative pressure generated when the external fluid pressurized by the pump device 13 flows inside. The external fluid is, for example, external air (outside air). The ejector device 14 is equipped with the nozzle part 140, the suction part 141, and the diffuser part 142. The exterior air pumped by the pump device 13 flows through an external fluid passage 17. The ejector device 14 is installed in a passage between the external fluid passage 17 the second purge passage 16*b*.

The external fluid passage 17 connects the ejector device 14 to an exterior of the system, and air pumped with the pump device 13 flows from the exterior into the ejector device 14 through the external fluid passage 17. The pump device 13 is disposed in the external fluid passage 17. The pump device 13 is a fluid drive device which is equipped with, for example, a turbine rotated by a motor to intake external air and to pump the external air toward the nozzle part 140. Therefore, the air sent by the pump device 13 flows into the ejector device 14 from the nozzle part 140, and causes negative pressure to the suction part 141 as pressurization fluid. Thus, evaporation fuel is drawn from the suction part 141 through the first purge passage 16*a*.

The second purge passage 16*b* is a fuel outflow channel through which mixture fluid of the evaporation fuel passing through the ejector device 14 and the external air is made to flow into the intake passage 210. An axial center of the second purge passage 16*b* may be in agreement with an axial center of the external fluid passage 17.

The nozzle part 140 constitutes a choke passage relative to the air flowing into. The inside diameter of the nozzle part 140 is gradually made smaller toward the tip end. One end of the choke passage is connected to the external fluid passage 17, and the other tip end of the choke passage is extended toward the second purge passage 16*b*. The nozzle part 140 raises the flow velocity of the air flowing from the exterior through the external fluid passage 17 according to the choke effect. Therefore, negative pressure is generated at the tip end of the nozzle part 140 where high-speed air flows.

The suction part 141 is a passage extending in a direction crossing with or perpendicular to the nozzle part 140, and is connected to the tip end of the nozzle part 140. Due to the negative pressure at the nozzle part 140, the suction part 141 draws the evaporation fuel from the first purge passage 16*a*.

The diffuser part 142 is a passage downstream of the nozzle part 140 and the suction part 141, and the inside diameter is gradually increased as extending toward the second purge passage 16*b*. One end of the diffuser part 142 is connected to the nozzle part 140 and the suction part 141, and the other end of the diffuser part 142, where the diameter is increased, is connected to the second purge passage 16*b*. The diffuser part 142 reduces the pressure of air and evaporation fuel flowing inside. The axial center of the nozzle part 140 and the diffuser part 142 is in agreement with the axial center of the external fluid passage 17 and the second purge passage 16*b*. That is, the nozzle part 140, the diffuser part 142, the external fluid passage 17, and the second purge passage 16*b* have the same axial center.

At a time of purging evaporation fuel, the pump device 13 is operated, and the outside air flows into the ejector device 14 from the nozzle part 140 to flow out of the diffuser part 142 to the second purge passage 16*b*. At this time, due to the suction effect of the ejector device 14, the evaporation fuel adsorbed in the canister 12 passes through the first purge passage 16*a*, and is drawn into the ejector device 14 from the suction part 141.

The evaporation fuel drawn from the suction part 141 flows into a cylindrical passage defined in the ejector device 14 at a position between the nozzle part 140 and the diffuser part 142. In the middle of the cylindrical passage, the drawn evaporation fuel is mixed with air flowing into the diffuser part 142 from the nozzle part 140, and the mixture of fuel and air is supplied to the intake passage 210 through the second purge passage 16*b*. Therefore, the evaporation fuel flowing from the canister 12 into the first purge passage 16*a* does not pass through the pump device 13, as the evaporation fuel does not flow backward to the pump device 13. The evaporation fuel supplied to the intake passage 210 in this way flows into the intake manifold 20, and is mixed with fuel for combustion supplied to the internal combustion engine 2 from an injector to be combusted within the cylinder of the internal combustion engine 2.

The air filter 24 is disposed at the upstream part of the intake pipe 21 to catch dust contained in intake air. The throttle valve 23 is an intake amount control valve interlocked with an accelerator, and adjusts the valve opening at the entrance part of the intake manifold 20, such that the amount of intake air flowing into the intake manifold 20 is controlled. Intake air passes in order of the air filter 24, the throttle valve 23 and the intake manifold 20, and is mixed with fuel for combustion injected from an injector to have a predetermined air/fuel ratio before combusted within a cylinder.

The fuel tank 10 is a container which stores fuel such as gasoline. The fuel tank 10 is connected to the inflow part of the canister 12 by piping which forms the vapor passage 15. The canister 12 is a container filled with adsorption material such as activated carbon, and takes in the evaporation fuel generated in the fuel tank 10 through the vapor passage 15 to temporarily adsorb onto the adsorption material. The canister 12 has a canister closing valve 11 (CCV 11) which opens and closes the intake part for taking in external fresh air. Atmospheric pressure can be made to act in the canister 12, when the canister 12 is equipped with CCV 11. The canister 12 can easily desorb (purge) the evaporation fuel adsorbed on the adsorption material due to the fresh air.

The canister 12 has the outflow part from which the evaporation fuel desorbed from the adsorption material flows out. An end of piping which forms the first purge passage 16*a* is connected to the outflow part. The other end of piping which forms the first purge passage 16*a* is connected to the suction part 141 of the ejector device 14. The purge passage 16 is constituted so that the first purge passage 16*a*, the suction part 141, the diffuser part 142, and the second purge passage 16*b* are arranged in this order from the canister 12 toward the intake passage 210 of the internal combustion engine.

The control device 3 is an electronic control unit of the evaporation fuel purge system 1. The control device 3 is equipped with a microcomputer with a central processing unit (CPU) to perform operation processing and control processing, memory such as ROM and RAM, and I/O port (input/output circuit). The control device 3 performs basic control such as fuel purge in the evaporation fuel purge system 1. For this reason, the control device 3 is connected to each actuator of the pump device 13 and the CCV 11 to control the pump device 13 and the CCV 11.

The control device 3 is connected to the motor of the pump device 13. Regardless of operation/stop of the internal combustion engine 2, the control device 3 drives the motor to control the pump device 13. Signals corresponding to the number of rotations in the internal combustion engine 2, the amount of intake air, and temperature of cooling water are inputted into the input port of the control device 3.

The evaporation fuel drawn from the canister 12 into the intake manifold 20 is mixed with fuel for combustion supplied to the internal combustion engine 2 from an injector, and is combusted within the cylinder of the internal combustion engine 2. An air/fuel ratio which is a mixture ratio of the fuel for combustion and intake air in the cylinder of the internal combustion engine 2 is controlled to be a predetermined air/fuel ratio which is defined beforehand. The control device 3 controls the output of fluid pumped by the pump device 13, such that the purge amount of evaporation fuel can be controlled to maintain the predetermined air/fuel ratio while the evaporation fuel is purged.

The advantages of the evaporation fuel purge system 1 of the first embodiment are explained. The evaporation fuel purge system 1 includes the fuel tank 10, the canister 12, the intake passage 210 of the internal combustion engine 2, the purge passage 16, the ejector device 14, and the pump device 13 that sends external air to flow into the nozzle part 140. The ejector device 14 includes the nozzle part 140, the suction part 141, and the diffuser part 142, and is located in the middle of the purge passage 16. The suction part 141 draws the evaporation fuel from the canister 12 by the drawing force of air ejected from the nozzle part 140. The air ejected from the nozzle part 140 and the evaporation fuel drawn from the suction part 141 are mixed in the diffuser part 142, and the pressure of the mixture fluid is lowered by the diffuser part 142, such that the mixture fluid is emitted toward the intake passage 210.

Accordingly, when the pump device 13 pumps external air into the nozzle part 140, the drawing force to draw the evaporation fuel can be made to act on the suction part 141. Due to the drawing force, evaporation fuel is drawn from the canister 12, and is mixed with the outside air taken in from the nozzle part 140 in the ejector device 14 so as to produce the mixture fluid. The mixture fluid can be emitted toward the intake passage 210, after the pressure of the mixture fluid lowers.

Thus, the evaporation fuel purge system 1 can provide a gas supply course which supplies the mixture fluid of external air and evaporation fuel to the intake passage 210. At this time, evaporation fuel flows through the purge passage 16, and evaporation fuel does not flow through the inside of the pump device 13. Therefore, a flameproof structure is not needed for the purge pump that supplies evaporation fuel in the evaporation fuel purge system 1. Further, the purge pump does not increase resistance for a flow of evaporation fuel. For example, it is unnecessary for the purge pump to adopt a flameproof structure where sparks do not contact evaporation fuel, and it does not need to use a brushless motor as a motor of the purge pump.

Second Embodiment

An evaporation fuel purge system 101 according to a second embodiment is explained with reference to FIG. 2-FIG. 6. The composition, action, and effect the same as the first embodiment are not explained in the second embodiment.

The evaporation fuel purge system 101 prevents evaporation fuel from being emitted to the atmosphere after generated in the fuel tank 10. If a hole is generated in the purge system, there is concern that fuel is emitted to the atmosphere as a leak in the evaporation fuel purge system. Moreover, even if an abnormality such as leak arises, big influence does not appear in operation of the internal combustion engine 2, such that the driver of vehicle may not notice the abnormality. So, the second embodiment is aimed to detect an abnormality in the purge system at an early stage.

The evaporation fuel purge system 101 includes a bidirectional rotation pump 113 and a subcanister 19. The bidirectional rotation pump 113 is a fluid drive device with blades rotated in the right direction and the reverse direction by a motor, such that fluid can be sent in the two directions opposite from each other. The subcanister 19 has a container equipped with adsorption material such as the same activated carbon as the canister 12. The subcanister 19 is located between the nozzle part 140 of the ejector device 14 and the bidirectional rotation pump 113, and evaporation fuel which passes through the container is adsorbed to the adsorption material.

The bidirectional rotation pump 113 intakes external air toward the nozzle part 140 when the blades are rotated in the right direction. When the blades are rotated in the reverse direction, the bidirectional rotation pump 113 intakes fluid in a piping which defines a target passage toward the exterior. At the time of abnormality detection control, the control device 3 controls the motor of the bidirectional rotation pump 113 to rotate in the reverse direction. When supplying evaporation fuel to the intake passage 210, the control device 3 controls the motor of the bidirectional rotation pump 113 to rotate in the right direction.

The evaporation fuel purge system 101 further includes a check valve 4 which is a valve gear installed at a terminal area where the second purge passage 16*b* and the intake passage 210 of the internal combustion engine 2 are connected to each other. The check valve 4 allows fluid to flow into the intake passage 210 from the second purge passage 16*b*, and prohibits fluid from flowing backward from the intake passage 210 to the second purge passage 16*b*. Due to the check valve 4, the evaporation fuel purge system 101 can detect leak of the evaporation fuel in the target passage which is a specific area in the evaporation fuel purge system 101.

The target passage is a passage where an abnormality such as hole or disconnection in duct or hose is detected in the evaporation fuel purge system 101. Therefore, the target passage is set at least in the second purge passage 16*b*. Furthermore, the target passage may be also set in the first purge passage 16*a* because leak can be detected in the first purge passage 16*a* in addition to the second purge passage 16*b*. The range of target passage may also cover the fuel tank 10, the vapor passage 15, the canister 12, the ejector device 14, the subcanister 19, the external fluid passage 17, and the bidirectional rotation pump 113.

Figure 3:
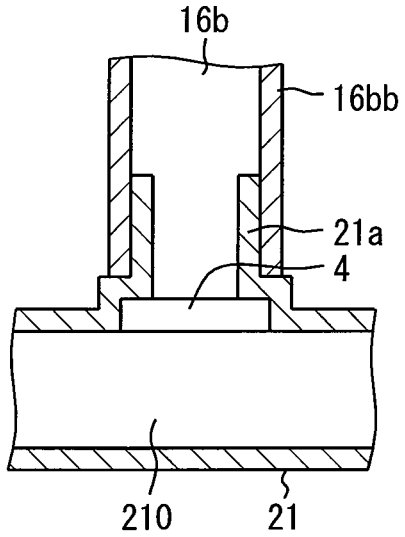
FIG. 3 is an enlarged view illustrating a check valve and an intake pipe in the evaporation fuel purge system of the second embodiment.

The check valve 4 is installed in the intake pipe 21 as a duct component which forms the intake passage 210. As shown in FIG. 3, the check valve 4 is positioned in a cylindrical terminal area 21*a* of the intake pipe 21 having a cylindrical shape extended in a direction intersecting the axis of the intake passage 210. The check valve 4 fully closes the passage in the cylindrical terminal area 21*a*. Thus, the check valve 4 is installed in the intake pipe 21, not in a duct 16*bb* which forms the second purge passage 16*b*. Due to the backflow preventing function of the check valve 4, the whole passage in the duct 16*bb* can be full of evaporation fuel. Therefore, when a leak such as hole exists at an arbitrary place of the duct 16*bb*, the evaporation fuel full of the target passage will certainly leak. The evaporation fuel purge system 101 has an abnormality detecting function that detects the leak and that determines an abnormality is occurred in the purge system.

The control device 3 performs basic control such as fuel purge in the evaporation fuel purge system 1, and has an abnormality determining circuit 30 that determines an abnormality in the system as an abnormality determining portion. For this reason, the control device 3 is connected to each actuator of the bidirectional rotation pump 113 and the CCV 11 to control the bidirectional rotation pump 113 and the CCV 11.

A signal corresponding to the internal pressure of the fuel tank 10 detected by a pressure sensor 18 is inputted into the input port of the control device 3. The evaporation fuel purge system 101 can determine abnormality such as leak in the passage ranged from the check valve 4 to the fuel tank 10, using the pressure in the fuel tank 10 detected by the pressure sensor 18.

Figure 4:
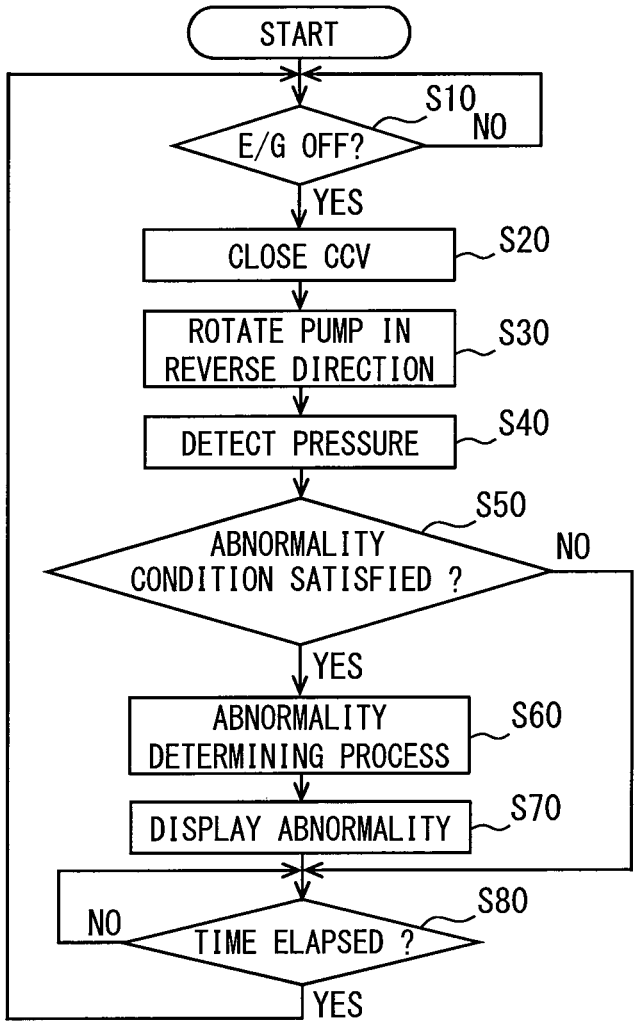
FIG. 4 is a flow chart for explaining a procedure of abnormality detection control in the second embodiment.

The abnormality detection control of the second embodiment is explained with reference to the flow chart of FIG. 4. The control device 3 performs processing according to the flow chart of FIG. 4. This flow chart shows a control to detect whether a passage included in the range of the target passage is in an abnormality state.

This flow chart operates when the internal combustion engine 2 of the vehicle is stopped. That is, the abnormality detection control of the evaporation fuel purge system 101 is periodically performed in the OFF state of the internal combustion engine 2.

When the flow chart is started, the control device 3 determines whether the internal combustion engine 2 is stopped at S10, repeatedly until it is determined that the internal combustion engine 2 is stopped. When it is determined that the internal combustion engine 2 is stopped at S10, the control device 3 closes the CCV 11 at S20, and controls the bidirectional rotation pump 113 to rotate the blades in the reverse direction at S30. Outside air is prevented from flowing into the first purge passage 16*a* from the canister 12, and the fluid of the purge passage 16 is drawn by the bidirectional rotation pump 113. Thus, the passage included in the range of the target passage is in a negative pressure state.

At this time, since the intake passage 210 and the second purge passage 16*b* are intercepted from each other by the check valve 4, the purge passage 16 and the intake passage 210 have no communication. Since the evaporation fuel drawn by the bidirectional rotation pump 113 is adsorbed by the adsorption material of the subcanister 19, evaporation fuel does not pass through the pump, such that fuel can be restricted from being emitted to the atmosphere.

The control device 3 continues this state for a predetermined period of time, and sets a determination possible state where it is possible to detect an abnormality in the target passage. At S40, the control device 3 acquires the pressure in the target passage intercepted from the intake passage 210, by receiving the pressure signal detected by the pressure sensor 18.

At S50, the abnormality determining circuit 30 of the control device 3 determines whether an abnormality condition is satisfied. The abnormality condition is a condition for determining whether an abnormality such as leak is occurred to the target passage in the determination possible state.

The evaporation fuel purge system 101 detects change in physical quantity relevant to the pressure change in the target passage, and determines whether the passage is normal or abnormal at S50. The physical quantity relevant to the pressure change is a physical quantity which has a specific change in each of the normal time and the abnormal time. For example, the physical quantity is a pressure measured about the target passage, a power consumption, consumption current, consumption voltage, or the number of rotations of the bidirectional rotation pump 113, or a change in drive cycle of reciprocating movement or piston. In the case of the number of rotations of the pump, a time period taken for a unit of rotation number is equivalent to a drive cycle.

Figure 5:
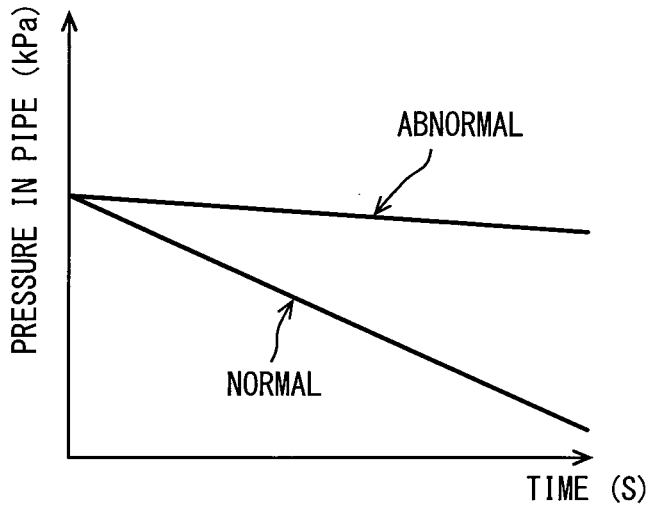
FIG. 5 is a graph illustrating a pressure change in a pipe which defines a target passage.

In the second embodiment, the abnormality determination is performed using, for example, change in the pressure detected by the pressure sensor 18. The graph of FIG. 5 illustrates a normal time example and an abnormal time example in the change of pressure detected by the pressure sensor 18, when the target passage is put in the negative pressure state by compulsorily discharging the fluid to outside with the bidirectional rotation pump 113. In this case, as shown in FIG. 5, the pressure value of the pressure sensor 18 falls with progress of time at the normal time. The decreasing rate at the abnormal time is smaller than that at the normal time.

Figure 6:
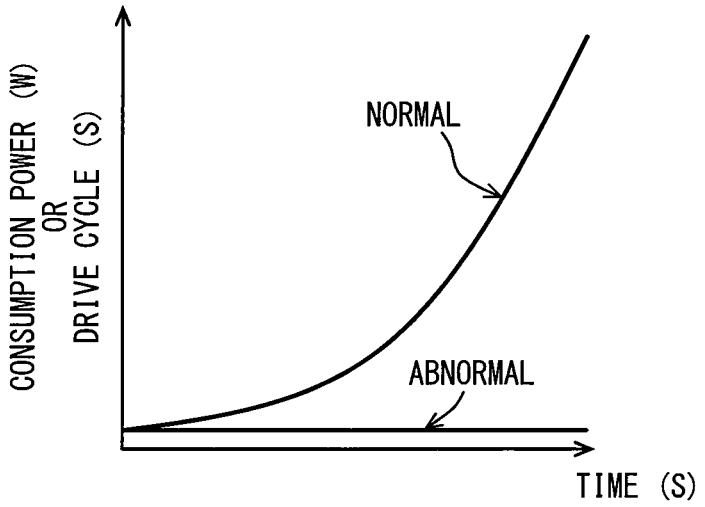
FIG. 6 is a graph illustrating change in consumption power or drive cycle of a purge pump.

As the physical quantity relevant to the pressure change in the target passage, power consumption, consumption current, or consumption voltage of the bidirectional rotation pump 113 or a change in the drive cycle such as the pump rotation number may be used in the evaporation fuel purge system 101. In this case, as shown in FIG. 6, the power consumption of the bidirectional rotation pump 113 is increased with progress of time at the normal time. The rate of change at the abnormal time is smaller than that at the normal time. The consumption current and consumption voltage have similar curves as FIG. 6 representing the power consumption or the drive cycle.

When there is no leak in the target passage at S50, as shown in the normal time of FIG. 5, the pressure of the target passage that is controlled to be in the negative pressure state is changed so that the degree of negative pressure becomes large gradually by the drawing force of the bidirectional rotation pump 113. On the contrary, when there is a leak in the target passage, as shown in the abnormal time of FIG. 5, since evaporation fuel leaks outside, the negative pressure state is not so much changed in the target passage while the drawing force acts on the bidirectional rotation pump 113. The abnormality condition of S50 shall be satisfied, for example, when a pressure change per unit time (rate of pressure change) is less than a first predetermined value defined beforehand. Therefore, the abnormality determining circuit 30 determines that there is abnormality, when the rate of pressure change is less than the first predetermined value. When the rate of pressure change is larger than or equal to the first predetermined value, the abnormality determining circuit 30 determines that there is no abnormality.

The abnormality condition of S50 may be satisfied when change in the consumption current per unit time (rate of change in the consumption current) is less than a second predetermined value defined beforehand. The abnormality determining circuit 30 determines there is abnormality, when the rate of change in the consumption current is less than the second predetermined value. When the rate of pressure change is larger than or equal to the second predetermined value, the abnormality determining circuit 30 determines that there is no abnormality.

When the abnormality determining circuit 30 determines that the abnormality condition is not satisfied at S50, the system is normal. The abnormality detection control is ended and the control device 3 progresses to S80. At S80, it is determined whether a predetermined time passes after performing S50. That is, processing of S80 is repeatedly performed until the next determination timing comes. When it is determined that the predetermined time have passed at S80, the control device returns to S10 and processing of subsequent abnormality detection control is performed again. Thus, abnormality detection control of the evaporation fuel purge system 101 is repeatedly performed at predetermined time interval.

When the abnormality determining circuit 30 determines that the abnormality condition is satisfied at S50, the control device 3 determines that there is abnormality in the target passage at S60. Furthermore, at S70, it indicates that the target passage is in abnormal condition, and the abnormality detection control is ended to progress to S80. The abnormality display is carried out by lighting or blinking a predetermined lamp, or by showing an abnormality display to a predetermined screen to show there is abnormality in the target passage. This abnormality display can also be substituted by generating a warning sound.

Figure 7:
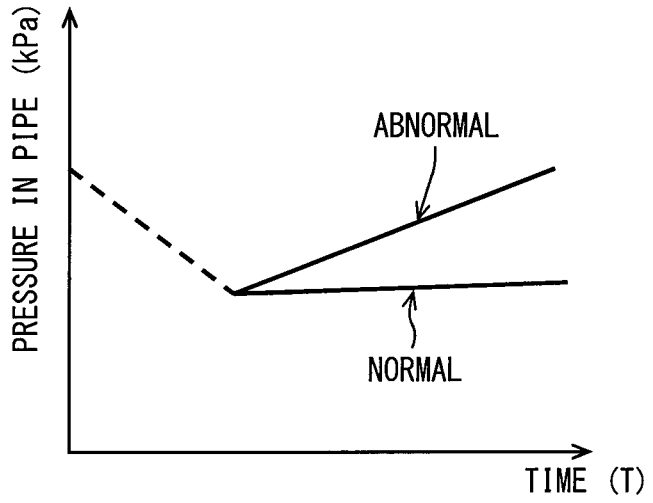
FIG. 7 is a graph illustrating a pressure change in a pipe which defines a target passage.

The processing of S50 may be performed also by a method explained below. When it is determined that the internal combustion engine 2 is stopped at S10, the CCV 11 is closed at S20, and the bidirectional rotation pump 113 is controlled to rotate the blades in the reverse direction at S30. Then, the bidirectional rotation pump 113 is stopped. At this time, the pressure of the target passage detected by the pressure sensor 18 changes, as shown in the dashed line of FIG. 7, so that the negative pressure state gradually advances. The graph of FIG. 7 illustrates a normal time example and an abnormal time example in the change of pressure detected by the pressure sensor 18, when the target passage is put in the negative pressure state by compulsorily discharging the fluid to outside with the bidirectional rotation pump 113. In this case, as shown in FIG. 7, the pressure value of the pressure sensor 18 changes at the abnormal time, since outside air flows into with progress of time. Specifically, the degree of negative pressure is lowered. The degree of negative pressure does not change at the normal time.

Because the bidirectional rotation pump 113 is stopped, the target passage in the negative pressure state is intercepted from the exterior. Therefore, the abnormality condition of S50 is satisfied, for example, when the pressure change per unit time (rate of pressure change) is larger than or equal to a third predetermined value defined beforehand. The abnormality determining circuit 30 determines that there is abnormality, when the rate of pressure change is larger than or equal to the third predetermined value. When the rate of pressure change is less than the third predetermined value, the abnormality determining circuit 30 determines that there is no abnormality.

Advantages of the evaporation fuel purge system 101 of the second embodiment are explained. The evaporation fuel purge system 101 includes the bidirectional rotation pump 113 able to draw fluid from the purge passage 16 to outside. That is, the bidirectional rotation pump 113 is a fluid drive device which sends fluid in the two directions opposite from each other using the blades rotated by a motor in the right direction and the reverse direction.

Furthermore, the evaporation fuel purge system 101 is equipped with the check valve 4 to allow the evaporation fuel emitted from the diffuser part 142 to flow into the intake passage 210 from the purge passage 16, and to prohibit fluid from flowing backward from the intake passage 210 to the purge passage 16.

Furthermore, the evaporation fuel purge system 101 is equipped with the abnormality determining circuit 30 which determines an abnormality such as leak in the purge passage 16 in the state where the bidirectional rotation pump 113 draws the fluid of the purge passage 16. The abnormality determining circuit 30 detects the predetermined physical quantity relevant to the pressure change in the target passage including the purge passage 16, and determines an abnormality in the system according to the detected predetermined physical quantity.

Accordingly, due to the backflow preventing function of the check valve 4 and the drawing force of the bidirectional rotation pump 113, the leak generated in the purge passage 16 can be determined according to the detection value of the predetermined physical quantity relevant to the pressure change in the passage. Thereby, the purge system can detect the abnormality in the purge passage 16 that is wide-ranged to the terminal area connected with the intake passage 210.

The evaporation fuel purge system 101 can complete the abnormality determining process in a short time by controlling the output of the bidirectional rotation pump 113.

The evaporation fuel purge system 101 includes the subcanister 19 which adsorbs evaporation fuel contained in the fluid of the purge passage 16 drawn by the bidirectional rotation pump 113. Accordingly, evaporation fuel can be adsorbed with the subcanister 19 when determining the abnormality, while there is concern that evaporation fuel may be emitted to atmosphere by passing the pump due to the drawing force of the bidirectional rotation pump 113. Therefore, the evaporation fuel purge system 101 can control diffusing of HC gas in fuel to the atmosphere with the pump having no flameproof structure.

The check valve 4 is installed in the intake pipe 21 which is a duct component forming the intake passage 210, instead of the duct 16*bb* which forms the purge passage 16. The check valve 4 is indirectly attached to the purge passage 16. The whole purge passage 16 can be made into the closed space by the check valve 4, when the check valve 4 exhibits the backflow preventing function. Thus, the whole purge passage 16 can be full of evaporation fuel. Therefore, abnormality can be determined relative to the whole purge passage 16.

The predetermined physical quantity used for determining abnormality by the abnormality determining circuit 30 is the internal pressure of the fuel tank 10. Accordingly, the abnormality of the purge passage 16 can be determined using the detection value of the pressure sensor 18 that is mounted to detect the internal pressure of the fuel tank 10.

The predetermined physical quantity used for determining abnormality by the abnormality determining circuit 30 is at least one of power consumption, consumption current, consumption voltage, and drive cycle such rotation number of the bidirectional rotation pump 113. The abnormality determining circuit 30 determines abnormality according to change in the predetermined physical quantity. Because the pressure change in the target passage acts on the bidirectional rotation pump 113 as resistance, the abnormality determining circuit 30 detects change in power consumption or drive cycle such as pump rotation number, as information relevant to the load of the bidirectional rotation pump 113. The change in power consumption or drive cycle such as pump rotation number can be easily acquired. Therefore, the abnormality determining circuit 30 can detect the important information relevant to the pressure change in the target passage without measuring directly the pressure in the duct defining the target passage. Thus, the number of components for the system can be reduced because a sensor for detecting the pressure in the duct can be made unnecessary.

Third Embodiment

Figure 8:
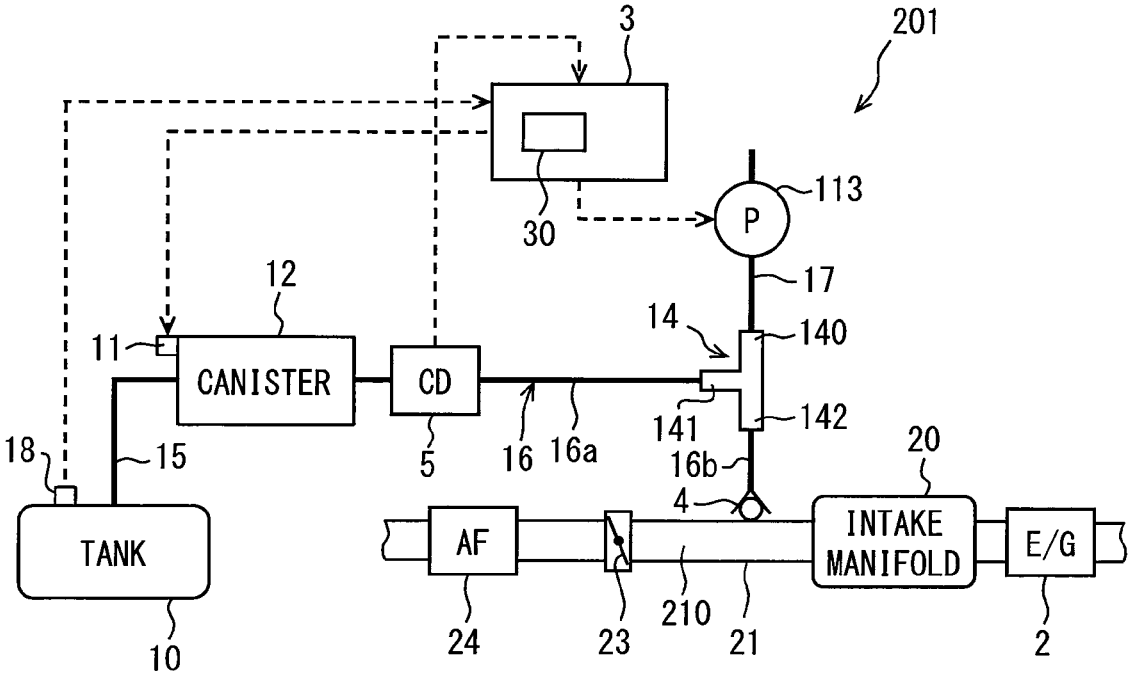
FIG. 8 is a schematic view illustrating an evaporation fuel purge system according to a third embodiment.
Figure 9:
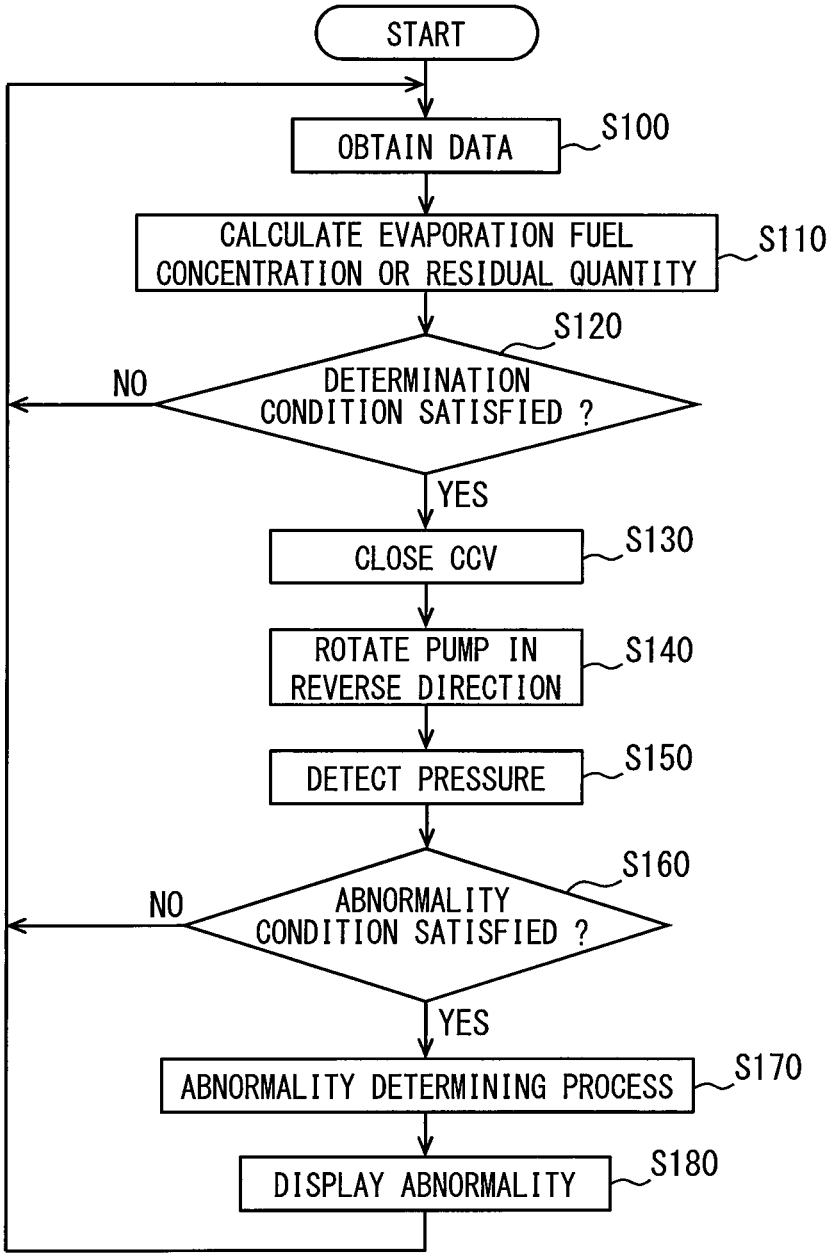
FIG. 9 is a flow chart for explaining a procedure of abnormality detection control in the third embodiment.

An evaporation fuel purge system 201 according to a third embodiment is explained with reference to FIG. 8 and FIG. 9. The composition, action, and effect the same as the above embodiment are not explained in the third embodiment.

The evaporation fuel purge system 201 includes a concentration detector 5 to detect a concentration of evaporation fuel in the fuel-air mixture of air and evaporation fuel purged into the intake passage 210. The concentration detector 5 is explained below. The concentration detector 5 includes a difference pressure sensor, a subcanister, a first electromagnetic valve, a second electromagnetic valve, a choke part, a first detection passage, a second detection passage, and an atmospheric air passage.

One end of the first detection passage is connected at the middle of the purge passage 16. The other end of the first detection passage is connected to one end of the second detection passage through the second electromagnetic valve. The other end of the second detection passage is opened to the atmosphere through an air filter. One end of the atmospheric air passage is connected to the second electromagnetic valve. The other end of the atmospheric air passage is opened to the atmosphere through an air filter. The choke part is defined between the second electromagnetic valve and the air filter in the second detection passage.

The second electromagnetic valve is a three-way electromagnetic valve. According to the control signal output from the control device 3, the choke part communicates with the atmosphere such that the second detection passage communicates with the atmospheric air passage. Alternatively, the choke part communicates with the first detection passage such that the first detection passage communicates with the second detection passage.

The subcanister is located between the choke part and the air filter. The first electromagnetic valve is disposed between the subcanister and the choke part. The first electromagnetic valve is a normally-closed two-way electromagnetic valve. According to the control signal output from the control device 3, the choke part communicates with or is disconnected from the subcanister.

A pump is disposed between the air filter and the subcanister. The subcanister holds adsorption material such as activated carbon, like the canister 12. In a state where the first detection passage and the second detection passage are made to communicate with each other, when the pump operates to decompress the second detection passage, the evaporation fuel adsorbed on the canister 12 is drawn to the second detection passage. When the fuel-air mixture passes the subcanister, the subcanister adsorbs evaporation fuel to remove evaporation fuel from the fuel-air mixture. For this reason, while the fuel-air mixture passes the choke part, the difference pressure sensor detects the pressure of air which passes the choke part.

The difference pressure sensor is disposed in the passage which connects the atmospheric air passage to the second detection passage between the pump and the subcanister, and detects pressure in the choke part. The difference pressure sensor detects a difference pressure between pressure in the second detection passage between the pump and the choke part and the atmospheric pressure in the atmospheric air passage connected to the atmosphere through the air filter. Therefore, the difference pressure detected by the difference pressure sensor, while the pump is operated, is substantially equal to a difference pressure between both ends of the choke part, in the state where the first electromagnetic valve is open. In the state where the first electromagnetic valve is closed, since the second detection passage is bclosed at the intake side of the pump, the difference pressure detected by the difference pressure sensor, while the pump is operated, is substantially equal to the shutoff pressure of the pump.

The control device 3 calculates the concentration of evaporation fuel in the fuel-air mixture purged into the intake passage 210 based on the pressure detection signal output from the difference pressure sensor of the concentration detector 5. Moreover, the control device 3 controls the fuel injection amount injected from a fuel injection valve according to the air/fuel ratio detected by the air/fuel ratio sensor and the calculated concentration of evaporation fuel.

The control device 3 memorizes the density of air, and the density of gas when the concentration of evaporation fuel is 100% beforehand in the memory. The control device 3 calculates the concentration of evaporation fuel by performing a predetermined operation using the density of air, the density of gas when the concentration of evaporation fuel is 100% (i.e., evaporation fuel), the shutoff pressure, air pressure, and pressure of fuel-air mixture.

The shutoff pressure is detected by the difference pressure sensor when the pump is operated to decompress the second detection passage and when the first electromagnetic valve is closed. The air pressure is detected by the difference pressure sensor when the pump is operated to decompress the second detection passage and when the first electromagnetic valve is opened such that the second detection passage and the atmospheric air passage communicate with each other by switching the second electromagnetic valve. When the fuel-air mixture passes the choke part, the pressure of fuel-air mixture is detected by the difference pressure sensor, while the pump is operated to decompress the second detection passage and while the first electromagnetic valve is opened such that the second detection passage and the first detection passage communicate with each other by switching the second electromagnetic valve.

The abnormality detection control of the third embodiment is explained with reference to the flow chart of FIG. 9. The control device 3 performs processing according to the flow chart of FIG. 9. This flow chart shows a control to detect whether the vapor passage 15, the first purge passage 16*a*, or/and the second purge passage 16*b* are in abnormality state.

The abnormality detection control of the evaporation fuel purge system 1 carries out an abnormality determination based on this flow chart at S160, when the execution condition of the abnormality determination is satisfied at S120.

When the flow chart is started, the control device 3 obtains data at S100, and the data is used for the operation at S110. The various data detected at S100 includes data provided by the concentration detector 5, the detection signals provided by the difference pressure sensor, and the detection signals provided by the pressure sensor 18.

At S110, the control device 3 performs processing to calculate the concentration of evaporation fuel or the residual quantity of the evaporation fuel in the canister. The concentration of evaporation fuel can be calculated by the method mentioned above using the concentration detector 5.

The residual quantity of the evaporation fuel in the canister is the amount of the evaporation fuel which remains in the canister 12, and can be calculated by subtracting the amount of purge from the amount of evaporation fuel generated from the fuel tank 10. The amount of purge is calculated using the concentration of evaporation fuel. The amount of evaporation fuel generated from the fuel tank 10 is computed using a difference in fuel temperature (for example, difference in fuel temperature per unit time), the empty space of the fuel tank 10, and the internal pressure of the fuel tank 10. Alternatively, the amount of evaporation fuel generated from the fuel tank 10 is computed using a difference between the actual amount of purge and the theoretical value computed from the canister desorption performance characteristic (for example, a relationship between the aeration amount of canister and the desorption amount of canister). The desorption amount of canister can be calculated based on the aeration amount of canister using the canister desorption performance characteristic.

At S120, the control device 3 determines whether the execution condition of abnormality determination is satisfied. The execution condition is a condition set for determining whether an abnormality determination processing should be executed to determine an abnormality in the target passage in the determination possible state. The target passage includes the vapor passage 15, the first purge passage 16*a*, the second purge passage 16*b*, the concentration detector 5, the fuel tank 10, the canister 12, the ejector device 14, the external fluid passage 17, and the bidirectional rotation pump 113.

At S120, it is determined whether the concentration of evaporation fuel calculated at S110 is lower than or equal to a predetermined first threshold value. When the concentration of evaporation fuel is lower than or equal to the first threshold value, it is determined that the execution condition of abnormality determination is satisfied, and progresses to S130. When the concentration of evaporation fuel is higher than the first threshold value, it is determined that the execution condition of abnormality determination is not satisfied, and returns to S100.

Alternatively, at S120, it is determined whether the residual quantity of the evaporation fuel in the canister is lower than or equal to a predetermined second threshold value using the concentration of evaporation fuel calculated at S110. When the residual quantity of the evaporation fuel in the canister is lower than or equal to the second threshold value, it is determined that the execution condition of abnormality determination is satisfied, and progresses to S130. When the residual quantity of the evaporation fuel in the canister is higher than the second threshold value, it is determined that the execution condition of abnormality determination is not satisfied, and returns to S100.

S130, S140, and S150 are equivalent to S20, S30, and S40 which are mentioned above, respectively, and perform same processing at each step. Furthermore, S160, S170, and S180 are equivalent to S50, S60, and S70 which are mentioned above, respectively, and perform same processing at each step. Furthermore, after S180, this abnormality detection control is ended, and returns to S100.

Advantages of the evaporation fuel purge system 201 of the third embodiment are explained. The evaporation fuel purge system 201 determines whether the abnormality determining circuit should execute the abnormality determination according to the concentration of the evaporation fuel detected by the concentration detector. For example, the concentration of the evaporation fuel flowing from the canister 12 through the purge passage 16 is calculated by the abnormality determining circuit 30.

When the concentration of evaporation fuel is lower than or equal to the first threshold value, it is determined that the execution condition of the abnormality determination is satisfied at S120. Accordingly, an abnormality is determined when the concentration of the evaporation fuel of the purge passage 16 is low. Therefore, the influence of evaporation fuel on the exterior can be made small. For example, even when a leak has actually occurred to the purge passage 16, the abnormality determination can be carried out by restricting the influence of leak on the environment.

The abnormality determining circuit 30 determines that the execution condition of the abnormality determination is satisfied when the residual quantity of the evaporation fuel in the canister is below the second threshold value, based on the concentration of evaporation fuel flowing out of the canister 12 through the purge passage 16. Therefore, the influence of evaporation fuel on the exterior can be made small, similarly to the case where the concentration of evaporation fuel is below the first threshold value.

As mentioned above, in this embodiment, the difference pressure sensor is used as a concentration detector. In addition, other detector to detect concentration using $O_2$ sensor, contact combustion, infrared rays, gas heat conduction, and ultrasonic wave can be used. By arranging such a concentration detector to the place of the concentration detector 5, it is possible to acquire the same advantages as the case using the difference pressure sensor.

Fourth Embodiment

An evaporation fuel purge system 301 according to a fourth embodiment is explained with reference to FIG. 10 and FIG. 11. The composition, action, and effect the same as the above embodiment are not explained in the fourth embodiment.

The evaporation fuel purge system 301 is able to supply the evaporation fuel of the purge passage 16 to the intake passage 210 with the pressure of intake air in the internal combustion engine 2. Therefore, in the evaporation fuel purge system 301, evaporation fuel can be purged by the negative pressure of the intake air in the internal combustion engine 2 in the state where the pump device 13 is stopped.

Figure 10:
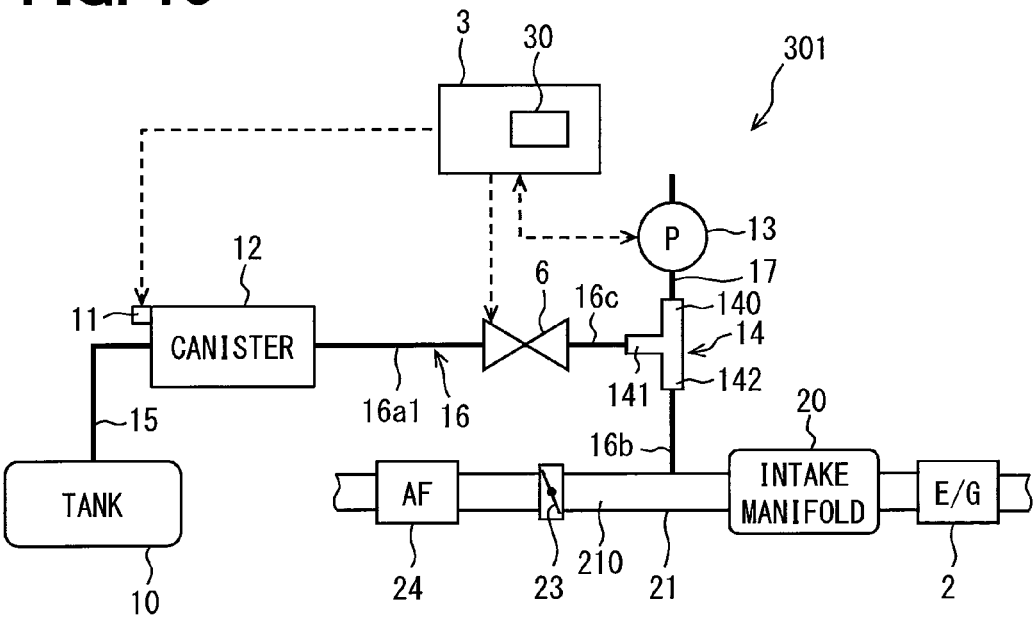
FIG. 10 is a schematic view illustrating an evaporation fuel purge system according to a fourth embodiment.

As shown in FIG. 10, the evaporation fuel purge system 301 is equipped with a purge control valve 6. The purge control valve 6 is an opening-and-closing portion to open and close the purge passage 16, i.e., the passage for supplying evaporation fuel, and is able to allow and prohibit the supplying of the evaporation fuel from the canister 12 to the internal combustion engine 2. The purge control valve 6 may be an electromagnetic valve equipped with an valve object, an electromagnetic coil, and a spring, for example.

The control device 3 controls the valve opening of the purge control valve 6. The purge control valve 6 is able to allow and prohibit supply of the evaporation fuel to the suction part 141 from the canister 12. The purge control valve 6 opens and closes the passage for supplying evaporation fuel, for example, according to the balance between the biasing force of the spring and the electromagnetic force generated when electricity is supplied to the coil.

Normally, the purge control valve 6 maintains the state where the passage for supplying evaporation fuel is closed. When the electromagnetic coil is energized by the control device 3, the electromagnetic force is larger than the biasing force of the spring such that the passage for supplying evaporation fuel is opened. Moreover, the control device 3 energizes the coil by controlling the duty ratio, i.e., the ratio of the ON time to one cycle constructed of the ON time and OFF time. The purge control valve 6 is also called as duty control valve. Thus, the flow rate (the amount of purge) of the evaporation fuel flowing through the passage for supplying evaporation fuel can be adjusted. Moreover, the pump device 13 may have a structure which prevents inflow of external air at a stop time. The external fluid passage 17 may have a valve structure which prevents inflow of external air at the stop time of the pump device.

In the fourth embodiment, the first purge passage 16*a* is separately defined as a first purge passage 16*a*1 between the canister 12 and the purge control valves 6, and a third purge passage 16*c* between the purge control valve 6 and the suction part 141. Therefore, when the purge control valve 6 is closed, evaporation fuel cannot flow into the third purge passage 16*c* from the first purge passage 16*a*1.

The flow rate (the amount of purge) of the evaporation fuel supplied to the intake passage 210 from the purge passage 16 is controlled to satisfy the request amount of purge demanded from the vehicle (hereafter referred to demanded amount or request value). Therefore, when the demanded amount cannot be satisfied with the amount of purge by the negative pressure of intake air in the internal combustion engine 2, the evaporation fuel is supplied using the pump device 13 and the ejector device 14.

Figure 11:
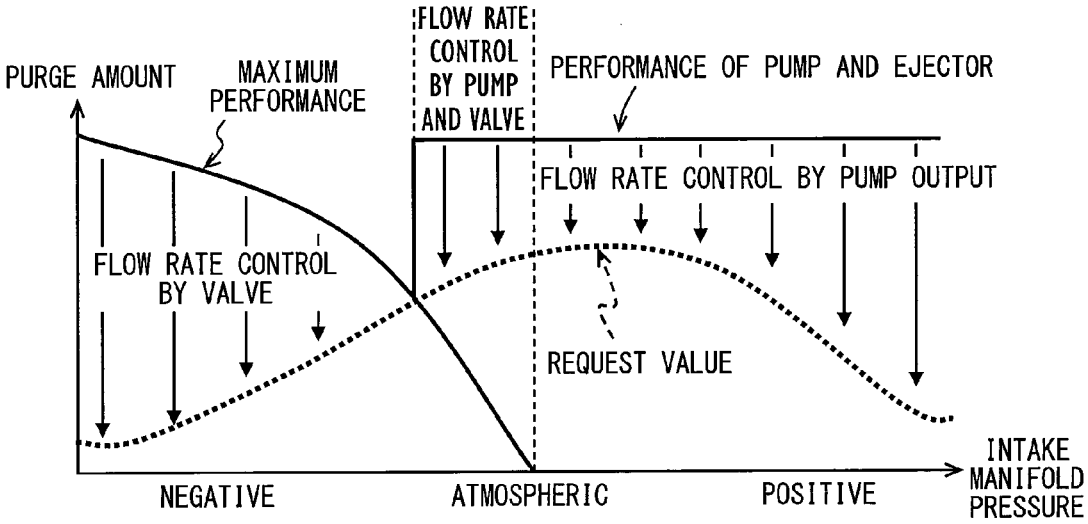
FIG. 11 is an explanatory chart for explaining a flow rate control in which a negative pressure of intake air by an internal combustion engine and an air pumping by a pump are combined.

FIG. 11 illustrates a chart for explaining the flow rate control in which the negative pressure of intake air by the internal combustion engine 2 and the air pumping by the pump device 13 are combined. As shown in FIG. 11, the control device 3 performs plural control methods according to the range of the negative pressure of intake air of the internal combustion engine 2 (intake manifold pressure) to satisfy the demanded amount of purge. The control device 3 acquires information on the demanded amount from the vehicle ECU, and the demanded amount may change according to the valve opening of the throttle valve 23.

Since the maximum purge amount of the negative pressure exceeds the demanded amount in the area where the negative pressure of intake air of the internal combustion engine 2 is large, the control device 3 controls the amount of purge by controlling the valve opening of the purge control valve 6 by duty ratio control mentioned above to meet the demanded amount. Moreover, the maximum purge amount of the negative pressure is beforehand memorized by memory such as ROM and RAM, as a map. The control device 3 calculates the present value of the maximum purge amount of the negative pressure using the acquired intake manifold pressure and the map.

In the area where the maximum purge amount of the negative pressure is less than the demanded amount, since the negative pressure of intake air of the internal combustion engine 2 is small, the control device 3 controls the amount of purge by controlling the valve opening of the purge control valve 6 and the output of the pump device 13 to satisfy the demanded amount.

In the area where the negative pressure of intake air of the internal combustion engine 2 cannot be obtained, the control device 3 controls the output of the pump device 13 in the state where the valve opening of the purge control valve 6 is set the maximum, to control the amount of purge to satisfy the demanded amount. Therefore, in this area, the demanded amount is secured by the performance of the pump device 13 and the performance of the ejector device 14.

Fifth Embodiment

Figure 12:
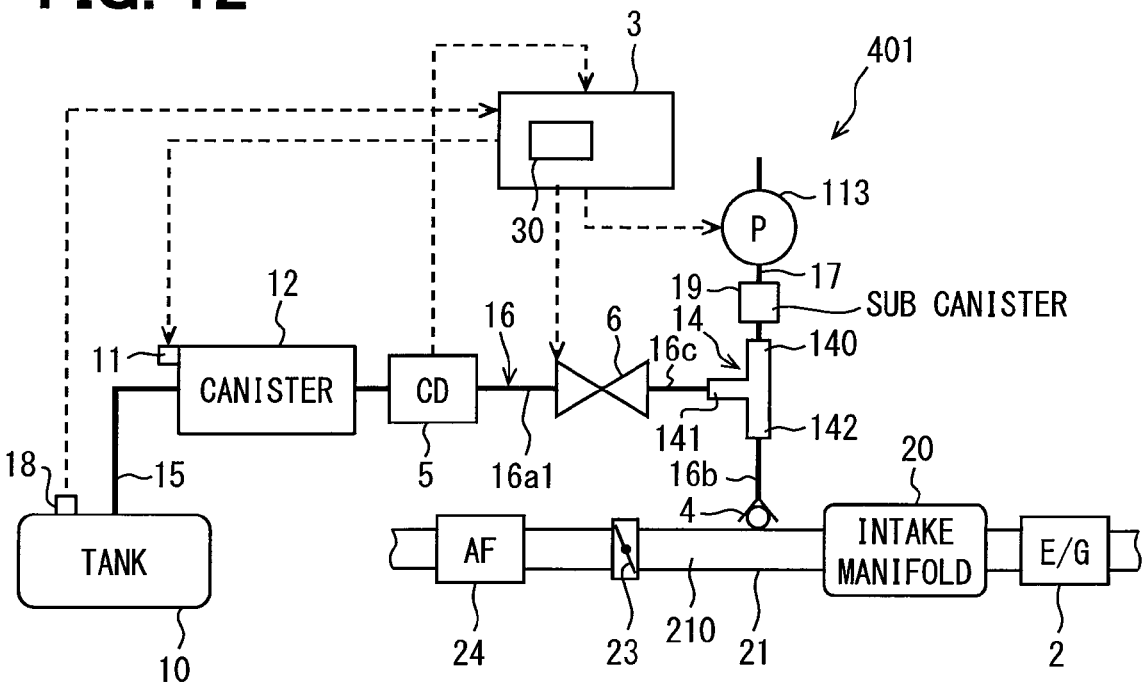
FIG. 12 is a schematic view illustrating an evaporation fuel purge system according to a fifth embodiment.

An evaporation fuel purge system 401 according to a fifth embodiment is explained with reference to FIG. 12. The composition, action, and effect the same as the above embodiment are not explained in the fifth embodiment.

The evaporation fuel purge system 401 combines the system of the second embodiment, the system of the third embodiment, and the system of the fourth embodiment. Therefore, the evaporation fuel purge system 401 can supply the evaporation fuel of the purge passage 16 to the intake passage 210 with the manifold air pressure of the internal combustion engine 2.

In the evaporation fuel purge system 401, when abnormality such as leak exists in the target passage, the evaporation fuel full of the target passage will certainly leak. The target passage includes the vapor passage 15, the first purge passage 16*a*, the second purge passage 16*b*, the concentration detector 5, the purge control valve 6, the fuel tank 10, the canister 12, the ejector device 14, the external fluid passage 17, the subcanister 19, and the bidirectional rotation pump 113.

The evaporation fuel purge system 401 has an abnormality determining function to detect leak and to determine that an abnormality is occurred to the purge system. Therefore, the control device 3 performs basic control such as fuel purge in the evaporation fuel purge system 401, and also determines the abnormality in the system by the abnormality determining circuit 30. The abnormality detection control is the same as that in the second and third embodiments. When detecting abnormality, the purge control valve 6 is controlled to open.

Other Embodiment

The present disclosure may be variously modified without being restricted to the embodiment, in the range not deviated from the scope of the present disclosure.

The structures of the above embodiments are merely exemplary, and technical scopes of the disclosure are not limited to the disclosed scopes. The technical scope of the disclosure is represented by the claims, and includes meanings equivalent to those of the claims, and all changes in the scope.

The check valve 4 may be replaced with an electromagnetic valve which opens and closes a passage. In this case, the electromagnetic valve may be a valve gear controlled to the open state to open a passage when voltage is not impressed, and to the closed state to close a passage when voltage is impressed.

In the system of the third embodiment, it is desirable to carry out the abnormality determination in the state where the internal combustion engine 2 has stopped. However, the system of the third embodiment can carry out the abnormality determination in the state where the internal combustion engine 2 is operating.

The check valve 4 can also be replaced with an electromagnetic valve which electrically opens and closes a passage. In this case, the electromagnetic valve may be a valve gear controlled to the open state to open a passage when voltage is not impressed, and to the closed state to close a passage when voltage is impressed.

When the abnormality determining circuit 30 determines whether the abnormality condition is satisfied, the internal pressure of the fuel tank 10 may not be used, and the pressure detected with a pressure sensor at an arbitrary position in the purge passage 16 may be used.

In the second, third, and fifth embodiments, the evaporation fuel purge system can supply the evaporation fuel of the purge passage 16 to the intake passage 210 with the manifold air pressure of the internal combustion engine 2, and can detect abnormality such as leak in the target passage.

The abnormality determining circuit 30 may determine whether the abnormality condition is satisfied by the following methods. The control device 3 memorizes change at the normal time and change at the abnormal time in a memory, for example, as shown in FIG. 5, FIG. 6, and FIG. 7, as a map. In this case, the abnormality determining circuit 30 determines whether the abnormality condition is satisfied by determining the detected data resembles which map at the normal time or the abnormal time.

Such changes and modifications are to be understood as being within the scope of the present disclosure as defined by the appended claims.

What is claimed is:

1. An evaporation fuel purge system comprising:

a fuel tank that stores fuel;

a canister that absorbs evaporation fuel when evaporation fuel is emitted from the fuel tank, the canister being able to desorb the evaporation fuel;

an intake passage for an internal combustion engine in which the evaporation fuel desorbed from the canister is mixed with fuel for combustion;

a purge passage that connects the canister to the intake passage;

an ejector device disposed in the purge passage and having a nozzle part that accelerates external fluid flowing into, a suction part that draws the evaporation fuel from the canister by a drawing force produced by the external fluid ejected from the nozzle part, and a diffuser part that emits a mixture of the external fluid ejected from the nozzle part and the evaporation fuel drawn from the suction part into the intake passage; and a fluid drive device that sends outside air corresponding to the external fluid to flow into the nozzle part.

2. The evaporation fuel purge system according to claim 1, wherein the fluid drive device is able to send fluid in the purge passage to outside, the evaporation fuel purge system further comprising:

a valve device able to allow the evaporation fuel emitted from the diffuser part to flow into the intake passage from the purge passage, and able to prohibit fluid from flowing backward from the intake passage to the purge passage; and an abnormality determining circuit to determine an abnormality in the purge passage in a state where the fluid drive device draws fluid of the purge passage to outside, wherein the abnormality determining circuit detects a predetermined physical quantity relevant to a pressure change in a target passage including the purge passage, and determines an abnormality in the evaporation fuel purge system according to the predetermined physical quantity.

3. The evaporation fuel purge system according to claim 2 further comprising:

a subcanister that adsorbs evaporation fuel from the fluid of the purge passage drawn by the fluid drive device.

4. The evaporation fuel purge system according to claim 2, wherein the valve device is disposed in a duct component which forms the intake passage, and is not disposed in a duct which forms the purge passage.

5. The evaporation fuel purge system according to claim 2, wherein the predetermined physical quantity is an internal pressure of the fuel tank.

6. The evaporation fuel purge system according to claim 2, wherein the predetermined physical quantity is at least one of power consumption, consumption current, consumption voltage and drive cycle of the fluid drive device.

7. The evaporation fuel purge system according to claim 2 further comprising:

a concentration detector disposed in the target passage including the purge passage to detect a concentration of the evaporation fuel, wherein the abnormality determining circuit executes a determination to detect an abnormality based on the concentration of the evaporation fuel detected by the concentration detector.

8. The evaporation fuel purge system according to claim 1, wherein the nozzle part has an inside diameter gradually made smaller toward a tip end, and the diffuser part has an inside diameter gradually increased as extending toward the intake passage.

9. The evaporation fuel purge system according to claim 1, wherein the diffuser part is a passage downstream of the nozzle part and the suction part, the suction part is connected to a tip end of the nozzle part, and the nozzle part defines a choke passage relative to the external fluid flowing into.

10. The evaporation fuel purge system according to claim 1, wherein the nozzle part has an upstream end connected to an external fluid passage through which the external fluid flows into the nozzle part from outside through the fluid drive device, the external fluid passage, the nozzle part, and the diffuser part are connected in this order and extend parallel to each other, and the suction part extends in a direction intersecting the nozzle part and the diffuser part.

11. The evaporation fuel purge system according to claim 10, wherein the suction part extends in a direction perpendicular to the nozzle part and the diffuser part.

12. An evaporation fuel purge system comprising:

a fuel tank that stores fuel;

a canister that absorbs evaporation fuel when evaporation fuel is emitted from the fuel tank, the canister being able to desorb the evaporation fuel;

an intake passage for an internal combustion engine in which the evaporation fuel desorbed from the canister is mixed with fuel for combustion;

a purge passage that connects the canister to the intake passage;

an ejector device disposed in the purge passage and having a nozzle part that accelerates external fluid flowing into, the nozzle part having an end connected to an external fluid passage communicated to outside, the nozzle part defining a choke passage relative to the external fluid flowing into, a suction part that draws the evaporation fuel from the canister by a drawing force produced by the external fluid ejected from the nozzle part, the suction part being connected to a tip end of the nozzle part, the suction part being a passage extending in a direction intersecting the nozzle part, and a diffuser part that emits a mixture of the external fluid ejected from the nozzle part and the evaporation fuel drawn from the suction part into the intake passage, the diffuser part being located downstream of the nozzle part and the suction part; and a fluid drive device that sends outside air corresponding to the external fluid to flow into the nozzle part.

13. The evaporator fuel purge system according to claim 12, wherein the nozzle part has an inside diameter gradually made smaller toward the tip end, and the diffuser part has an inside diameter gradually increased as extending toward the intake passage.

14. The evaporator fuel purge system according to claim 12, wherein the external fluid passage, the nozzle part, and the diffuser part are connected in this order and extend parallel to each other.

15. The evaporator fuel purge system according to claim 12, wherein the suction part extends in a direction perpendicular to the nozzle part and the diffuser part.

16. The evaporator fuel purge system according to claim 1, wherein an external fluid passage communicated to outside, the nozzle part, the diffuser part and the purge passage communicated to the intake passage have similar axial centers.

17. The evaporator fuel purge system according to claim 12, wherein the external fluid passage, the nozzle part, the diffuser part and the purge passage communicated to the intake passage have similar axial centers.

18. The evaporator fuel purge system according to claim 1, wherein the ejector device is disposed in a middle of the purge passage.

19. The evaporator fuel purge system according to claim 12, wherein the ejector device is disposed in a middle of the purge passage.

* * * * *